United States Patent [19]

Shiroyama

[11] Patent Number: 4,990,874

[45] Date of Patent: Feb. 5, 1991

[54] CORE AND CONTACT ASSEMBLY FOR A COAXIAL ENGINE STARTER

[75] Inventor: Shigeru Shiroyama, Himeji, Japan

[73] Assignee: Mitsubishi Denki Kabushiki Kaisha, Tokyo, Japan

[21] Appl. No.: 501,208

[22] Filed: Mar. 29, 1990

[30] Foreign Application Priority Data

Mar. 30, 1989 [JP] Japan ..... 1-83180

[51] Int. Cl.[5] ..... H01H 51/08

[52] U.S. Cl. ..... 335/126; 335/131; 74/7 R

[58] Field of Search ..... 335/126, 131; 74/7 R, 74/7 A, 7 C, 7 E

[56] References Cited

U.S. PATENT DOCUMENTS 4,862,123 8/1989 Gray et al. ..... 335/126

4,907,464 3/1990 Isozumi ..... 335/131

*Primary Examiner*—H. Broome

*Attorney, Agent, or Firm*—Sughrue, Mion, Zinn

[57] ABSTRACT

A core and contact assembly for a solenoid switch in which a circumferential belt-shaped attractive force generating portion is formed on one surface of a core, a recess is formed in the attractive force generating portion, a removed portion is also formed in the core radially outwardly of the recess. Stationary contacts are disposed within the recess, and conductor portions extend from the stationary contacts to the other surface of the core through the removed portion. In order to insulatably secure the stationary contacts and the conductor portion with respect to the core, a resinous molded portion is provided, and a cover axially extending from the interior of the recess for surrounding around the stationary contacts is provided.

1 Claim, 5 Drawing Sheets

CORE AND CONTACT ASSEMBLY FOR A COAXIAL ENGINE STARTER

BACKGROUND OF THE INVENTION

This invention relates to a core and contact assembly and, more particularly, to a unitized core and contact assembly for a solenoid switch for use in a coaxial engine starter apparatus, for example, in which a solenoid switch is disposed behind an electric motor.

A conventional coaxial engine starter apparatus is constructed as illustrated in FIG. 1. Generally, the coaxial starter apparatus is arranged such that an armature rotary shaft 2 of a d.c. electric motor 1 is made hollow, a push rod 4 supported by a plunger rod 3*a* of a solenoid switch 3 disposed at the rear end of the d.c. motor 1 is inserted into an inner passage 2*a* of the armature rotary shaft 2 so that it abuts against an output rotary shaft 5, which is coaxially disposed at the front end of the armature rotary shaft 2, at an end face of the rear end portion of the output rotary shaft 5 inserted into the inner passage 2*a* of the armature rotary shaft 2, thereby allowing the output rotary shaft 5 to be pushed forward.

In this coaxial starter apparatus, a commutator 6 is mounted at the rear portion of the armature rotary shaft 2*a*, and a brush 9 supported by a holder 8 secured a mounting plate 7 is arranged to slidably contact the circumferential surface of the commutator 6. Behind a commutator assembly including the commutator 6, the brush 9 and the holder 8 and between the solenoid switch 3, a terminal assembly 11 in which two terminal bolts 10 (only one of the terminal bolts is illustrated in FIG. 1) are molded within a resin material is mounted at a notch formed in the circumferential surface of a rear bracket 1*b*, and on one side face of this terminal assembly 11, two stationary contacts 13 and 14 which can be short-circuited by a movable contact 12 of the solenoid switch 3 are disposed to project therefrom. These stationary contacts 13 and 14 are respectively formed integral with the terminal bolts 10 and therefore electrically conductive to each terminal bolt 10.

As for these two terminal bolts 10, one of them is connected by a wire to a battery mounted on the vehicle, and the other of them is connected by a wire to the positive side brush 9 as well as to a lead-in portion of an excitation coil 15 of the solenoid switch 3.

In FIG. 1, reference numeral 16 is a pinion mounted at the front end portion of the output rotary shaft 5 capable of engaging and disengaging an engine ring gear (not shown) by a reciprocating motion of the output rotary shaft 5, 17 is a planetary speed reduction gear for reducing the rotational speed of the armature rotary shaft 2, 18 is an over-running clutch assembly for transmitting the rotation speed-reduced at the planetary speed reduction gear 17 to the output rotary shaft 5 and for preventing reverse transmission of the high speed rotation of the engine from the output rotary shaft 5 to the d.c. electric motor 1.

However, in the coaxial starter apparatus as previously described, since the terminal assembly 11 and the core 19 which is one of the components of the solenoid switch 3 are constructed as separate components, the cost due to the increased number of parts is increased and, in addition, since a magnetic attractive force generating portion 19*a* (the hatched area in FIG. 2) is formed evading the contacts 13 and 14 to expose them (in other words, though partially, the stationary contacts are present inside thereof, so that the attractive force generating portion 19*a* cannot enter into the interior region), the thickness in the radial direction of the magnetic attractive force generating portion 19*a* is very thin due to the dimensional problem in conjunction with the inner diameter of the bushing 3*b* slidably supporting the plunger 20 of the solenoid switch 3, whereby the resulting magnetic cross sectional area is disadvantageously small and it is not possible to obtain a large magnetic attractive force.

SUMMARY OF THE INVENTION

The object of the present invention is to provide a core and contact assembly in which a core and contacts of a solenoid switch such as that used in the conventional coaxial starter apparatus are efficiently incorporated into a unit, thereby to decrease the number of parts and to obtain a massive magnetic attractive force.

The core and contact assembly of the present invention comprises an attractive force generating portion formed as a circumferential belt on one surface of a core, a recess formed in the attractive force generating portion, a resinous mold portion for insulatably securing the stationary contacts and the conductor portion with respect to the core, and a cover axially extending from the interior of the recess for surrounding around the stationary contacts.

According to the core and contact assembly of the present invention, the attractive force generating portion in the form of a circumferential belt formed on one of the surfaces of a core has formed therein a recess to mount the stationary contacts therein, and these stationary contacts are insulatingly secured to the core and surrounded by a cover, so that the radial thickness of the attractive force generating portion can be made very thick to provide a large magnetic cross-sectional area, causing the plunger to be attracted by a large force, whereby the movable contact is brought into contact with the stationary contacts under a heavy pressure and the movement of a driven component to which the plunger movement is transmitted is made stable.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

The core and contact assembly of the present invention will be described in detail in conjunction with the embodiments illustrated in the accompanying drawings.

Figure 1:
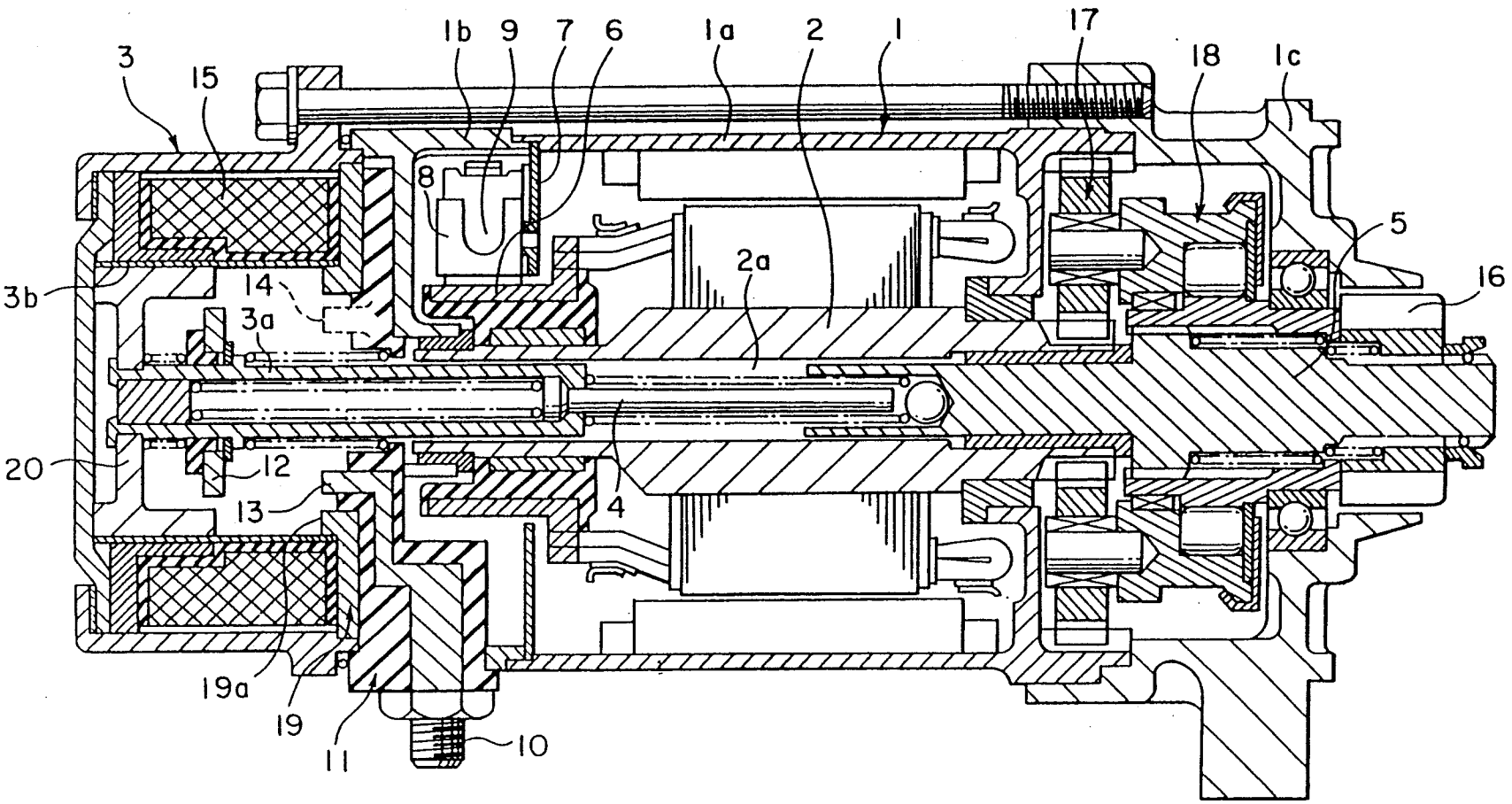
FIG. 1 PRIOR ART
FIG. 1 is a sectional view showing the conventional coaxial starter apparatus.
Figure 3:
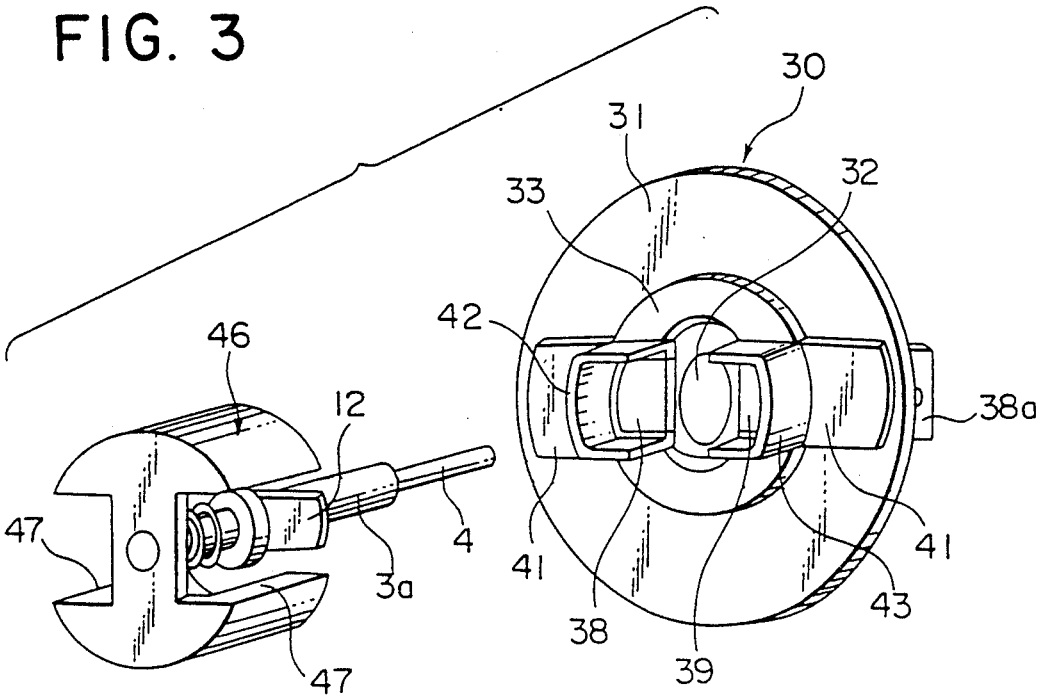
FIG. 3 is a perspective view illustrating the core and contact assembly with the plunger of one embodiment of the present invention.
Figure 7:
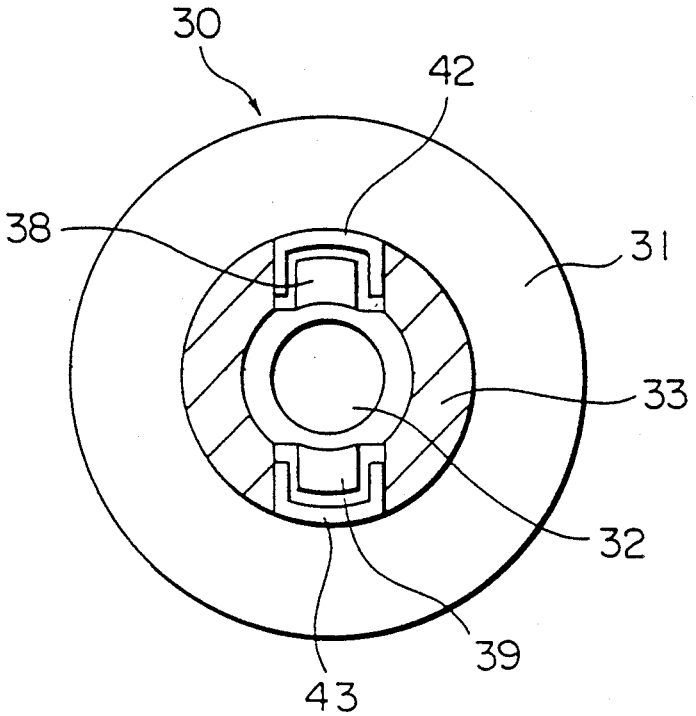
FIG. 7 is a schematic front view of the core and contact assembly of the embodiment illustrating the size of the attractive force generating portion.
Figure 8:
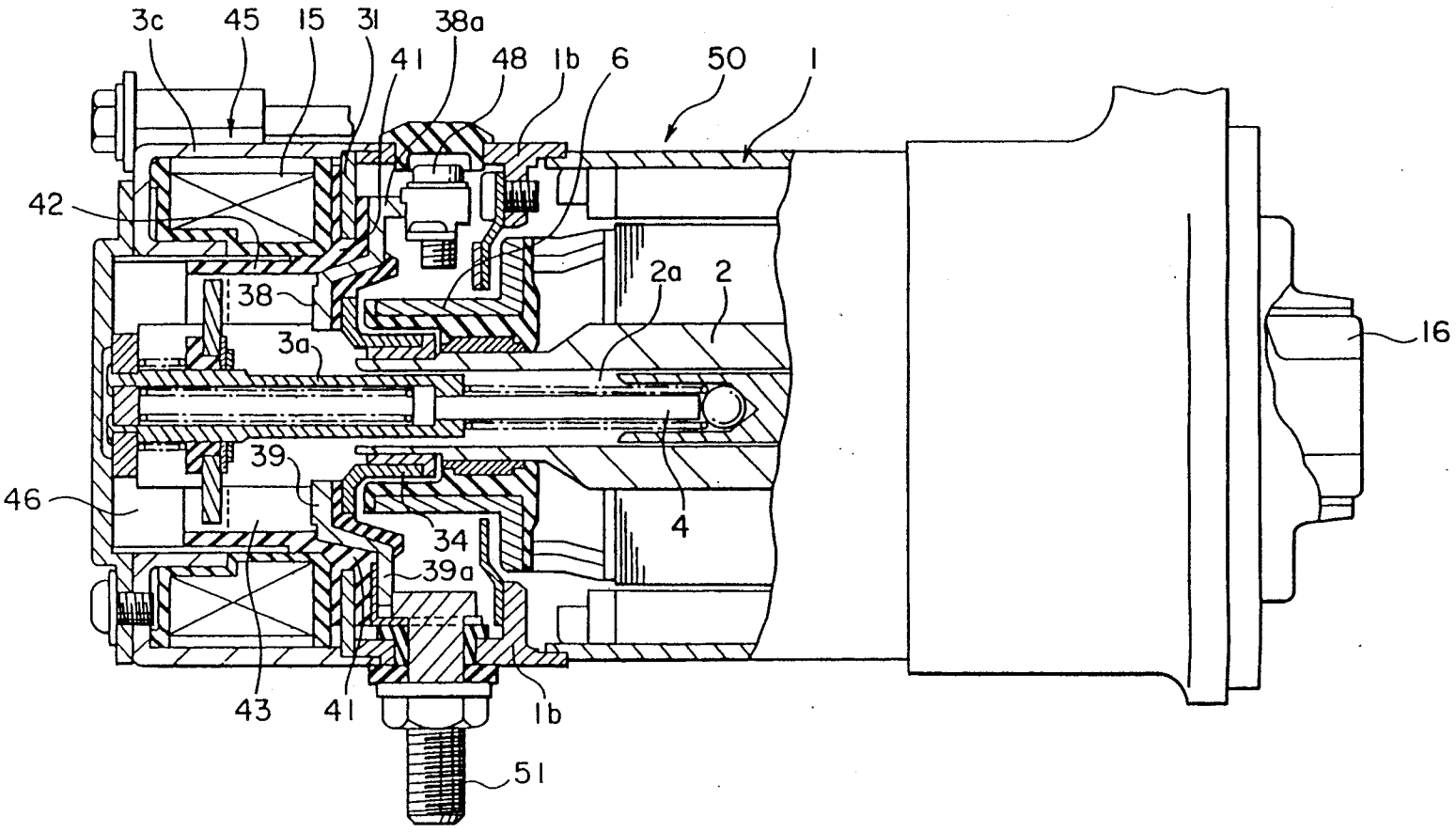
FIG. 8 is a partial sectional view of a coaxial starter apparatus employing the core and contact assembly of this embodiment shown in FIG. 3.

FIGS. 3 to 7 illustrate a core and contact assembly 30 which is one embodiment of the present invention, and FIG. 8 illustrates, in a partial sectional view, a coaxial starter apparatus 50 constructed by employing the core and contact assembly 30 illustrated in FIG. 3. In FIG. 8 illustrating the coaxial starter apparatus 50, those portions identical or corresponding to the components of the conventional coaxial starter apparatus illustrated in FIG. 1 are designated by the same reference numerals and their explanations will be omitted.

The core and contact assembly 30 of this embodiment comprises a disc-shaped core 31, which has formed in the central portion an opening 32 and has an attractive force generating portion 33 formed in a belt-shaped circumferential region along the peripheral edge of the opening 32 on one of the surface of the core 31 to slightly project in the direction of axis. On the other surface of the core 31, a cylindrical portion 34 extending from the peripheral edge of the opening 32 in the direction of the central axis is integrally formed. This cylindrical portion 34 engages the rear end of the armature rotary shaft 2 when the core and contact assembly 30 is assembled in the coaxial starter apparatus to support it.

Figure 4:
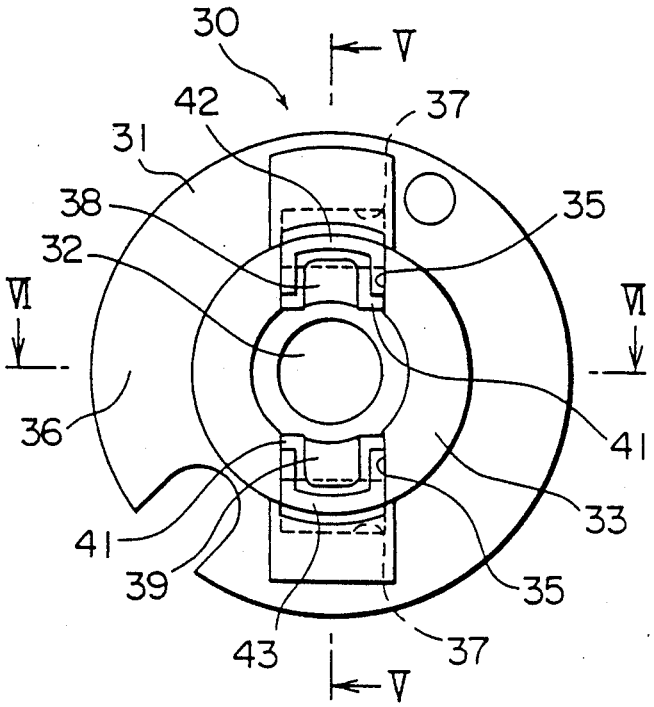
FIG. 4 is a front view illustrating the core and contact assembly shown in FIG. 3.

Further, this core 31 has formed in the belt-shaped circumferential region which is referred to as the attractive force generating portion 33 as illustrated in FIG. 4 recesses 35 for installing stationary contacts therein. The recesses 35 are formed in symmetry with respect to a radial transversal imaginary line 36 passing through the center of the core 31. In the core 31 on the radial line passing through the respective recesses 35, removed portions or windows 37 are formed to extend from the outside portion of the previously described belt-shaped circumferential region to the radially outward portion outside of the circumferential region.

Figure 5:
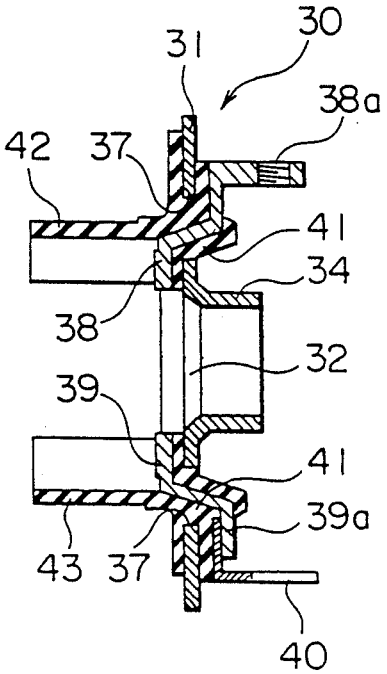
FIG. 5 is a sectional view of the core and contact assembly taken along the line V—V of FIG. 4.
Figure 6:
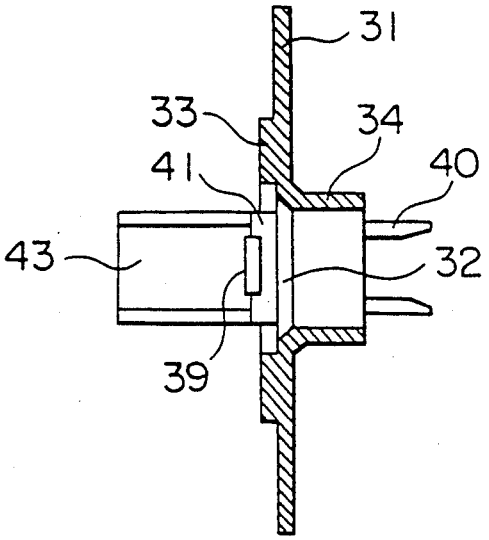
FIG. 6 is a sectional view of a core and contact assembly taken along line VI—VI of FIG. 4.

Within two recesses 35 formed in the belt-shaped circumferential region of the attractive force generating portion 33, the stationary contacts 38 and 39 are disposed, and conductor portions integral with the respective stationary contacts 38 and 39 extend, as shown in FIG. 5, through the respective windows 37 to the other side of the core 31, and an end portion of the conductor portion integral with one of the stationary contact 38 becomes a terminal **38*a* for the connection to the positive side brush of the d.c. motor 1, and an end portion of the conductor portion integral with the other stationary contact 39 is connected to a connecting plate 40** connected to the terminal bolt.

As the stationary contacts 38 and 39 are installed within the recesses 35 and the conductor portions integral with the contacts are exposed to the other side of the core 31 through the respective window 37, in order to secure the stationary contacts 38 and 39 as well as the conductor portions to the core 31 and establish an electrical insulation with respect to the core 31, the stationary contacts 38 and 39 less the contact surfaces thereof for contacting the movable contact and the portion of the conductor portion passing through the window are mold-embedded by a resin. These resin-molded portions are designated by reference numeral 41 in FIGS. 3 to 6. At this time, the resin-molded portions 41 are formed to partially project to both sides of the core 31 to increase the attaching function of the resin-molded portions 41 relative to the core 31. Also, covers 42 and 43 having a substantially U-shaped cross-section are disposed to axially extend from the recesses 35 in which the stationary contacts 38 and 39 are disposed, the covers 42 and 43 surrounding the respective stationary contacts 38 and 39 with its open regions faced toward the center of the core 31. The covers 42 and 43 are formed integral with the resin-molded portion 41.

An arrangement in which the core and contact assembly 30 as above constructed is assembled in the coaxial starter apparatus 50 will now be described with reference to FIG. 8. The core and contact assembly 30 is mounted in front of the armature side of a casing **3*c* (right side as viewed in FIG. 8) so as to fit around the outer circumference of the core 31, and the core and contact assembly 30 constitutes a solenoid switch 45 together with the casing 3*c*, the plunger 46, the movable contact 12, the plunger rod 3*a*, the coil 15, the bushing 3*b* and the like. Of these, the plunger 46 has notches 47 formed in its circumferential wall so that the plunger 46 does not interfere the axially extending covers 42 and 43 surrounding the stationary contacts 38 and 39 ensuring that the movement of the plunger 46** is not blocked.

Also, in the core and contact assembly 30, a terminal **38*a* of the conductor portion integral with the stationary contact 38 is electrically connected to a positive side brush by a screw 48, and the forked connecting plate 40 connected to the conductor portion integral with the stationary contact 39 is engaged and connected to a separate terminal bolt 51 attached to the rear bracket 1*b* of the coaxial starter apparatus 50**.

Figure 2:
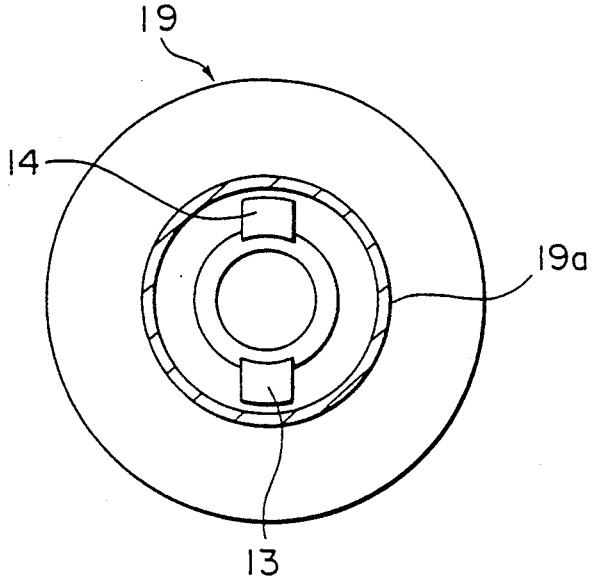
FIG. 2 is a an assembly view showing the arrangement of the core and the stationary contact used in the conventional coaxial starter apparatus.

According to such core and contact assembly 30, not only the core and the stationary contact which have been separate parts in a conventional design can be combined into a unit as a single part, but also the magnetic cross-sectional area can be significantly increased as apparent by comparing the attractive force generating portion **19*a* of the conventional core 19 shown in FIG. 2 and the attractive force generating portion 33 of the core and contact assembly 30 of this embodiment of the present invention shown by hatching in FIG. 7. Moreover, since the covers 42 and 43 surrounding the stationary contacts 38 and 39 are elongated in the axial direction, the contact particles or contact wear powders generated upon the contacting between the movable contact and the stationary contacts 38 and 39 can be prevented from scattering and spreading, whereby the attachment of the above-mentioned contact particles onto the inner circumferential surface of the bushing 3*b* on which the plunger 46 slides can be prevented and the generation of inadequate sliding of the plunger 46** can also be prevented.

While the conductor portion integral with the stationary contact 39 and the connecting plate 40 and the terminal bolt 51 connected to the conductor portion are separate members in the core and contact assembly of the above-described embodiment, these components can be integrally formed.

As has been described, according to the core and contact assembly of the present invention, a recess is formed in one portion of a belt-shaped attractive force generating portion circumferentially formed on one of the surfaces of a core so that a stationary contact is to be disposed therein, and one portion of the core is removed for allowing a conductor portion integral with the stationary contact to appear on the other surface of the core, and these stationary contact and the conductor portion are mold-secured by resin and the stationary contact is surrounded by a cover, whereby an inexpensive assembly having a high support strength of the stationary contact with respect to the core, and the magnetic cross-sectional area of the attractive force generating portion of the core can be made large, so that the plunger can be attracted with a massive force.

What is claimed is:

1. A core and contact assembly for a solenoid switch comprising a casing containing therein a coil bobbin in which an excitation coil is wound, and a plunger slidably inserted into a bushing mounted to the inner circumference of said coil bobbin, wherein a core is disposed at an axial end portion of said casing, and a movable contact supported by said plunger is adapted to engage two stationary contacts, said core and contact assembly comprising an attractive force generating portion formed as a circumferential belt on one surface of said core, a recess formed in said attractive force generating portion, a resinous mold portion for insulatably securing said stationary contacts with respect to said core, and a cover axially extending from the interior of said recess for surrounding around said stationary contacts.

* * * * *